US008152413B2

(12) United States Patent
Marks et al.

(10) Patent No.: US 8,152,413 B2
(45) Date of Patent: Apr. 10, 2012

(54) METHOD OF AND APPARATUS FOR BOUYANCY COMPENSATION FOR DIVERS

(75) Inventors: Lloyd A. Marks, Westfield, NJ (US); David W. Weber, South Lyon, MI (US)

(73) Assignee: Lloyd A. Marks, Westfield, NJ (US)

( * ) Notice: Subject to any disclaimer, the term of this patent is extended or adjusted under 35 U.S.C. 154(b) by 240 days.

(21) Appl. No.: 12/493,970

(22) Filed: Jun. 29, 2009

(65) Prior Publication Data

US 2010/0329794 A1 Dec. 30, 2010

(51) Int. Cl.
*B63C 11/44* (2006.01)

(52) U.S. Cl. ..... 405/193; 405/185; 405/186; 405/192

(58) Field of Classification Search ..... 405/185, 405/186, 192, 193; 441/88
See application file for complete search history.

(56) References Cited

U.S. PATENT DOCUMENTS

| | | | | |
|---|---|---|---|---|
| 3,161,026 | A | 12/1964 | Odum et al. | |
| 3,820,348 | A | 6/1974 | Fast | |
| 4,009,583 | A | 3/1977 | Buckle | |
| 4,068,657 | A | 1/1978 | Kobzan | |
| 4,101,998 | A | 7/1978 | Buckle | |
| 4,114,389 | A | 9/1978 | Bohmrich et al. | |
| 4,913,589 | A | 4/1990 | Faulconer et al. | |
| 5,221,161 | A | 6/1993 | Toy | |
| 5,256,094 | A | 10/1993 | Canna | |
| 5,496,136 | A | 3/1996 | Egan | |
| 5,551,800 | A | 9/1996 | Hobelsberger | |
| 5,560,738 | A | 10/1996 | Noel | |
| 5,562,513 | A | 10/1996 | Kaiser | |
| 5,707,177 | A | 1/1998 | Lehrer et al. | |
| 5,997,216 | A | 12/1999 | Kawashima | |
| 6,478,510 | B1 | 11/2002 | Young | |
| 6,592,298 | B2 | 7/2003 | Beltrani | |
| 6,666,623 | B1 | 12/2003 | Greene | |
| 6,796,744 | B2 | 9/2004 | Jacoway et al. | |
| 6,913,421 | B1 * | 7/2005 | Donahue | 405/186 |
| 2003/0181108 | A1 | 9/2003 | Jacoway et al. | |
| 2006/0120808 | A1 | 6/2006 | Roseborough | |

* cited by examiner

*Primary Examiner* — David Bagnell
*Assistant Examiner* — Benjamin Fiorello
(74) *Attorney, Agent, or Firm* — Blank Rome LLP

(57) ABSTRACT

An improved buoyancy compensation device having a lesser change in buoyancy with depth than conventional buoyancy compensation devices which use ambient pressure bladders is disclosed. The improved device comprises one or more elastic members that, throughout the working range of diving pressures and volumes, is always elastic and, when pressurized, maintains an internal air pressure that is always greater than the ambient pressure at any dive depth. The invention also relates to a method of providing a buoyancy compensation device with an elastic member having a lift versus depth characteristic that approaches the lift versus depth characteristic of a constant or fixed volume buoyancy compensation device.

34 Claims, 10 Drawing Sheets

METHOD OF AND APPARATUS FOR BOUYANCY COMPENSATION FOR DIVERS

BACKGROUND OF THE INVENTION

1. Field of the Invention

The present invention relates to buoyancy compensation devices for use by underwater divers, especially recreational SCUBA divers, and more particularly to a buoyancy compensation device that provides relatively constant buoyancy regardless of the diver's depth and a method of providing buoyancy compensation at relatively constant buoyancy for an underwater diver regardless of the diver's depth.

2. Description of the Prior Art

Typically, a SCUBA diver with dive gear, including a wetsuit and air tank, is positively buoyant and must wear lead weights in order to submerge. When the diver enters the water, the wetsuit has maximum buoyancy owing to the air in the pores of the expanded neoprene or butyl rubber from which wetsuits are typically made. As the wetsuit gets soaked with exposure to water and the air in the wetsuit is compressed as the diver descends to depths having pressures greater than atmospheric, it loses some of its buoyancy. Thus, the diver may have to overcome the tendency to sink. SCUBA divers typically use a "buoyancy compensation device" (BCD) to adjust buoyancy during a dive.

The BCD in current, relatively widespread use by divers, referred to herein as a "conventional BCD," is simply a substantially inelastic, inflatable bladder that can be filled and emptied of air that is always at ambient pressure. That is to say, the internal pressure of a typical inflated BCD bladder corresponds substantially to the external ambient pressure regardless of water depth; at the water surface the BCD bladder internal pressure is 14.7 psia and at about 150 feet water depth the BCD bladder internal pressure is about 80 psia, the ambient pressure in fresh water at about 150 feet depth.

By inflating the conventional BCD when at depth, the diver's tendency to sink owing to the compression of the diver's wetsuit, for example, can be overcome. As the diver uses up compressed air from the air tank, the tank becomes lighter, and thus more positively buoyant, typically, by about 5 lbs., which corresponds to about 5 lbs. of lift or about 2.25 liters of air volume. Thus, at the end of a dive, it may be difficult for a diver to stay submerged for a safety stop (to prevent decompression illness). Should the diver experience such difficulty, the diver can carry more lead on the next dive and, to be safe, can overestimate the lead requirement. Thus, according to this approach, the diver will carry a fairly large amount of lead and then compensate for the added weight by introducing air into the BCD bladder. Apart from having to carry the extra weight, this presents another problem for the diver.

The air that is forced into the conventional BCD bladder from the air tank displaces a given volume of water at a given depth, i.e., the deeper the dive, the more air will be required to produce the same volume displacement of water. The lift or buoyancy generated is equal to the weight of the water displaced from the BCD bladder. It would be desirable for this displacement to remain constant throughout the dive, regardless of the diver's depth. However, the air in the BCD bladder is compressed as the diver descends to deeper depths (producing less displacement and less lift) and expands when the diver ascends toward the surface (producing more displacement and more lift). The former situation is a nuisance; as the diver descends, he may find that he has a tendency to sink faster and must add air to the BCD bladder to compensate for the faster descent. However, the latter situation is not only a nuisance, but can be quite dangerous.

A brief description of lung volumes and their definitions will be helpful in understanding the following description of the prior art devices, as well as the invention and its operation and advantages over the prior art devices. A typical representation of lung volumes measured at atmospheric pressure is shown in the chart of FIG. 10 and in the following table:

| Lung Volume | Volume in liters | Description/Definition |
|---|---|---|
| Total lung capacity (TLC) | 6.0<br>IRV + TV + ERV + RV | The volume of air contained in the lungs at the end of maximum inspiration. Total volume of the lungs. |
| Vital capacity (VC) | 4.6<br>IRV + TV + ERV | The volume of air that can be expelled from the lungs after a complete maximum inspiration. |
| Tidal Volume (TV or VT) | 0.5 | The volume of air breathed in or out of the lungs during normal respiration. |
| Residual Volume (RV) | 1.2 | The volume of air left in the lungs after a maximum exhalation. |
| Functional Residual Capacity (FRC) | 2.4<br>ERV + RV | The volume of air that stays in the lungs during normal breathing. |
| Inspiratory Reserve Volume (IRV) | 3.0<br>VC − (TV + ERV) | The maximum volume of air that can be inspired into the lungs in addition to the tidal volume. |
| Inspiratory Capacity (IC) | 3.5<br>TV + IRV | The maximum volume of air that can be inspired into the lungs following a normal expiration. |
| Expiratory Reserve Volume (ERV) | 1.2 | The volume of air that can be expelled from the lungs after the expiration of a normal breath. |

Based on the chart and table, it can be seen that during normal breathing at tidal volume (TV) ±0.5 liter, a diver changes his buoyancy or lift only about ±1 lb. It can also be seen that if a diver inspires deeply after a normal inspiration, he can increase the air volume in his lungs by about an additional 3.0 liters (IRV) and thus increase his buoyancy by about 6.6 additional pounds. It can also be seen that if a diver exhales deeply after a normal expiration, he can decrease the air volume in his lungs by about an additional 1.2 liters (ERV) and thus decrease his buoyancy by about 2.6 pounds. A skilled diver can maintain a normal tidal volume, but increase his ERV and decrease his IRV so that he is breathing "near the top" of his vital capacity. Similarly, a skilled diver can maintain a normal tidal volume, but decrease his ERV and increase his IRV so that he is breathing "near the bottom" of his vital capacity. This permits the seasoned diver to adjust his buoyancy during the course of a dive to a magnitude that can come close to the changes in buoyancy caused by using up air and compressing his wetsuit.

If a diver ascends to the surface using a conventional BCD without carefully controlling his rate of ascent by releasing air from the BCD, the air in the BCD will increase in volume making him ascend faster, which further increases the BCD volume and so on, resulting in an "uncontrolled ascent." An uncontrolled ascent can cause two serious problems. One of these problems is decompression sickness, commonly called "the bends," which is caused by the release of dissolved nitrogen as a gas into the blood stream. An equally, if not more, serious problem can be caused by a rapid increase in the total lung volume. A skilled, relaxed diver knows to allow air to expel from the lungs during such a situation. A novice or panicked diver may keep his glottis closed. This, in turn, will cause an increase in lung volume beyond that which the lungs are capable of accommodating, which may rupture the alveoli, resulting in a pneumothorax. In such a situation the lung collapses and the air escapes into the chest. A pneumothorax can be fatal and is a common cause of death for the novice or panicked diver.

A diver should always ascend to the surface from depth at a slow, controlled rate. If the diver has been at depth for a significant time period, he may need to make a decompression stop to allow the dissolved nitrogen in his blood to slowly and safely come out of solution. Thus, controlled buoyancy is absolutely critical when a diver surfaces. As the air in the conventional BCD bladder expands upon ascending, the diver will tend to ascend faster which, in turn, increases lift more rapidly and causes acceleration of the diver's rate of ascension, an extremely dangerous condition, especially if a decompression stop is necessary before surfacing. In order to prevent this from happening with a conventional BCD, the diver must carefully release air from the BCD during ascension. Occasionally, even experienced divers do not accurately adjust the release of air from the conventional BCD and accidentally bypass a decompression stop.

Another problem can occur when a diver, experienced or not, wears a thick and, therefore, very buoyant wetsuit. To compensate for the extra lift of the wetsuit, the diver must wear more lead in order to descend. Then, when the wetsuit compresses, the diver becomes negatively buoyant to a degree that requires a significant volume of air to be introduced into the BCD. This large volume of air will vary considerably with depth and, thus, require the diver to frequently add to and reduce the BCD volume. Similarly, if a diver is carrying heavy equipment, he will be negatively buoyant to a degree that requires significant air in the BCD, making it necessary for the diver to carefully adjust buoyancy with depth changes so as to avoid the aforementioned "uncontrolled ascent" scenario with its accompanying difficulties.

It would clearly be a desirable objective to have a BCD that provides substantially constant lift or buoyancy, or at least a degree of lift or buoyancy that varies substantially less than that of the conventional BCD, regardless of the diver's depth. Ideally, the change in volume of a BCD during ascent should produce a change in lift that is no greater than the decrease in lift that a diver can achieve with a forced expiration, which, as explained above, is on the order of 3.0 pounds. Such a BCD would result in increased safety, because the diver could then stop an ascent with a forced exhalation only.

One approach that accomplishes the objective of constant or substantially constant lift or buoyancy regardless of depth is a rigid, constant or fixed volume buoyancy tank. However, because it is often necessary to adjust buoyancy, for the reasons mentioned above, e.g., wetsuit compression and tank air depletion, most prior art fixed volume tanks provide means for adjusting buoyancy. In those prior art devices, if it is desired to adjust (increase or decrease) the lift or buoyancy of the tank, the fixed volume of the tank can be changed by a movable piston inside the tank or, more typically, by flooding the tank with water or expelling water from the tank. U.S. Pat. Nos. 3,161,028; 4,009,583; 4,068,657; 4,101,998; 4,114,389; 5,221,161; and U.S. Patent Application No. 2006/0120808 disclose buoyancy compensation devices that utilize such a rigid, constant or fixed volume buoyancy tank with means to adjust the volume. Using such devices, a diver can adjust buoyancy for a given depth to achieve vertical equilibrium and then change depth to some extent with little or no need to readjust buoyancy.

There are, however, several disadvantages to these rigid tank types of buoyancy compensation apparatus. A constant or fixed volume buoyancy tank, as the term implies, is not deflatable and thus increases the overall size (occupied volume) of the BCD regardless of depth. This adds to the cumbersome nature of the already cumbersome array of equipment a SCUBA diver needs in order to enjoy safe and interesting dives. A further disadvantage of a floodable fixed volume buoyancy compensation apparatus is that buoyancy cannot be increased or decreased when the diver is in an inverted position (or in any position in which water or air cannot be expelled to ambient through the air and water valves), unless the constant volume tank is provided with water inlet-outlet valves at both the top and bottom of the constant volume tank. Such additional valves obviously increase the cost and complexity of a fixed volume BCD, as well as make the BCD more difficult for the diver to operate. Moreover, a floodable fixed volume buoyancy tank effectively functions no differently than the conventional BCD because the pressure inside the tank corresponds to ambient pressure (as typified by the aforementioned U.S. Pat. No. 5,221,161 and U.S. Patent Application No. 2006/0120808), unless the valving of the fixed volume BCD is also designed to isolate the fixed volume of air from ambient pressure.

Referring again to the conventional BCD, that prior art device employs a collapsible or substantially flaccid, inelastic bag or bladder, the volume of which can be increased or decreased in order to control the buoyancy of the diver. The bladder is essentially inelastic during its working range of pressures because the pressures inside (internal) and outside (ambient) the bladder are the same and, when completely full or inflated to its full volume, the bladder vents air to ambient surroundings to maintain substantially equal internal and ambient pressures, as well as maintain its inelastic condition and prevent unintended rupture of the bladder. As explained above, a significant disadvantage of such a BCD is that the internal volume of the bag or bladder increases rapidly with during ascent because of the decreasing pressure of the ambient water on the bag or bladder as the diver ascends. Unless the diver offsets this rapidly increasing volume by continuously releasing air to decrease the air volume in the bag or bladder, the diver may "overshoot" his intended decompression stop depth and dangerously and rapidly ascend to the surface thereby increasing the risk of decompression sickness or pneumothorax. To minimize this problem, a number of prior art BCDs utilize automatic buoyancy control systems which include hydrostatic valving systems responsive to ambient pressure to control the volume of the bag or bladder of the BCD during the diver's ascent or descent. Obviously, the cost and complexity of such hydrostatic valving systems and the risk of failure of their numerous components are major drawbacks to this approach.

One additional disadvantage of the prior art BCD's is that the air pocket in the BCD shifts according to the diver's position. Thus, there is generally a plurality of venting valves located at different points on the BCD. Typically, a modern BCD will have three such valves. Furthermore, to fully vent a BCD, a diver must take the large corrugated tube that exits the BCD at the diver's left shoulder and extend it as high as possible above his head to vent air from the BCD. In light of these disadvantages, it would be desirable to provide a BCD that forcibly expels all the air that was introduced during the dive, so that only a single exhaust valve would be necessary and the location of that valve could be arbitrarily positioned.

Yet another disadvantage of the prior art BCD's is the shifting of the air pocket in the bladder during a dive, which can result in imbalance, causing the diver to tilt toward the right or left. It would, therefore, also be desirable to provide a BCD in which the location of the air pocket is controlled, predictable, and balanced across the diver's breadth.

The conventional BCDs in current use comprise one or more inflatable bladders in the form of a belt or vest worn on or about the torso of the diver. A few examples of such prior art BCD are disclosed in U.S. Pat. Nos. 4,913,589; 5,256,094; 5,560,738; 5,562,513; 5,707,177; 6,478,510; 6,592,298; and 6,796,744. As previously mentioned, to control the addition and expulsion of air from the bladder, many prior art BCDs include mechanisms for automatically adjusting the buoyancy of the BCD bladder depending on the water depth or pressure or other parameters. Several of such prior art automatic BCDs are disclosed in U.S. Pat. Nos. 3,820,348; 5,496,136; 5,560,738; and 6,666,623. U.S. Pat. No. 5,551,800 discloses an automatically adjustable BCD which uses an expandable bellows with an internal spring as a buoyancy bladder or tank.

In light of the foregoing, it would be desirable to provide a BCD for a diver which has a relatively constant buoyancy regardless of diving depth, i.e., approaching that of a rigid, or fixed volume BCD, without the disadvantages of having a more complex and cumbersome buoyancy compensation system. It would also be desirable to provide a BCD with a displacement container or volume having a change of buoyancy with depth (lift versus depth characteristic) that approaches the constant lift versus depth characteristic of a rigid tank BCD and has a lift versus depth characteristic substantially better than that of the conventional BCD that employs an ambient pressure inflatable inelastic bladder for buoyancy control. Furthermore, it would be desirable to provide a BCD that overcomes the foregoing limitations and shortcomings of prior art BCD devices, has a minimum number of parts, is economical to manufacture and is easy, convenient and particularly safe for a diver to use.

SUMMARY OF THE INVENTION

The present invention is directed to an improved BCD that comprises one or more elastic members with a given initial internal volume or displacement at atmospheric pressure ("the base volume") that, during inflation, maintain(s) a substantially constant base volume until an internal pressure is reached ("the base pressure" or "yield point pressure") that is always substantially greater than the ambient pressure at any dive depth throughout the working range of diving pressures. At internal pressures above the base pressure, the internal volume of the tubular member(s) of the disclosed embodiment increases as described in more detail hereinafter. Although the BCD of the invention can be embodied in many different configurations than the configuration of the embodiment disclosed herein, key features of the invention are that the tubular member is elastic at any volume and that the base pressure is always substantially greater than the ambient pressure at any dive depth throughout the working range of diving pressures. A typical range of dive depth for recreational divers is from zero (14.7 psia) to 150 feet depth (80 psia). Thus, regardless of depth, the base pressure of the tubular member (or members) may be, for example, 20-40 psia or more greater than ambient pressure.

The invention also relates to a method of providing buoyancy compensation by providing a BCD that is always elastic and that has a lift versus depth characteristic that approaches the lift versus depth characteristic of a constant or fixed volume buoyancy compensation device.

According to its apparatus aspects, one embodiment of the BCD invention comprises one or more elastic tubular members connected via the first stage regulator and a manually-operated inflation/dump valve to the pressurized air tank of a SCUBA diving apparatus. The inflation and deflation functions can be accomplished with two valves that are preferably located close to one another so that they can be operated by one hand and so that the diver can easily switch between inflating and deflating the BCD. Alternatively, and preferably, the inflation and deflation functions are accomplished with a conventional single slider valve which has three positions, "neutral," "inflate" and "deflate." In the "neutral" position, the valve is closed. In the "inflate" position, the valve connects the BCD tubular members to the pressurized inflation tube. In the "deflate" position, the valve vents the BCD tubular members to ambient. It is common for such slider valves to be spring biased to return to the neutral position after an inflation or deflation function has been performed. In addition, an over-pressure relief valve may be provided as part of the slider valve, or elsewhere in the pneumatic system, to dump air more rapidly than the tubular members can be inflated when a predetermined over-pressure in the system is reached during an inflation condition.

The elastic tubular members may be sealed at both ends with rigid plastic end caps or by other means and contain a given, relatively small total displacement volume at atmospheric pressure (the base volume), e.g., a total of 0.4 to 1.0 liter for four tubular members. The tubular members are made of an elastomeric material, preferably a silicone rubber, such as a high shear and tear resistant Shore A (25-40) silicone rubber manufactured by Dow Chemical Company or Axon AB Plastics. Other elastomeric materials may be used for making the elastic tubular members of the present invention in light of the teachings herein, and such materials will be apparent to, or readily determined by, those of skill in that art.

In the preferred embodiment of the BCD invention disclosed herein, four tubular members are provided, two located on each side of the pressurized air tank at the diver's back along axes substantially parallel to the longitudinal axis of the air tank. The bottom end caps of each pair of tubular members are connected to a respective manifold that includes inlets/outlets for admitting or exhausting high pressure air to/from the tubular members via a passage in the bottom end caps. One manifold connected to a pair of tubular members is mounted on each side of the pressurized air tank by means of a manifold mounting bracket affixed to the frame or jacket of the SCUBA diving apparatus.

To limit the maximum volumetric expansion of the elastomeric tubular members in the radial as well as in the axial or longitudinal direction, each tubular member is provided with an external tubular first sleeve made of a substantially non-stretchable material, such as a woven nylon fabric, that is affixed, e.g., by clamps, at each of its ends to a respective top and bottom end cap. This external or first sleeve prevents over expansion of the tubular member beyond its desired maximum size and internal volume. In the unexpanded or uninflated or base volume condition of the tubular member, the first sleeve is slack or gathered about the tubular member.

A second sleeve, also made of a substantially non-stretchable nylon fabric, loosely surrounds each pair of tubular members and first sleeves and is affixed at its bottom end to a respective manifold and at its top end to the frame or jacket of the SCUBA diving apparatus. The purpose of the second sleeves is to constrain the tubular members to remain close to the diver's body when, for example, the diver is in a horizontal position looking down or to either side. If the tubular members were not so constrained when the diver is in the aforesaid horizontal positions, air in the tubular members may cause them to flex away from the diver's body and create a potential diving hazard for a diver, for example, attempting to pass through a submerged opening. It should be understood that other equivalent means or mechanisms could be employed in lieu of the second sleeves. For example, spring tension could be applied to the upper, free end of the tubular members to keep them parallel to one another and close to the diver's body as they inflate. Alternatively, the uninflated tubular members could be pre-stretched to their maximum inflated length and both top and bottom ends could be affixed to the SCUBA diving apparatus frame or jacket.

A third sleeve or covering made of a stretchable material or an elastic fabric, such as spandex, may be stretched over each second sleeve to snug each pair of tubular members and first and second sleeves up to the diver's back for streamlining and abrasion protection purposes. All the sleeves are preferably porous to air so that in the event of a rupture of one or more tubular members, the air would not be trapped in any of the three sleeves, which, if air were so trapped, could cause a sudden and undesired increase in buoyancy.

As pressurized air from the air tank via the regulator and inflation valve is introduced into the tubular members via the inlets in the bottom caps thereof, the internal pressure in the tubular members increases substantially before the internal volume of the tubular members (the base volume) begins to increase to any great extent. Although not to be considered as limiting the invention, in the embodiment described herein at ambient atmospheric pressure, the internal pressure in the tubular members reaches a base pressure of about 40 psia before the base volume and the rate of change of the base volume (dV/dt) begins to increase significantly, assuming that the rate of increase of pressure (dP/dt) is constant or substantially constant. In other words, the compliance of the tubular members, defined as the change in volume as a function of pressure (dV/dP), is low or substantially zero until the internal base pressure is reached at which point compliance begins to increase more rapidly. The internal base pressure at which compliance begins to increase significantly is also referred to herein as the "yield point pressure" and may be a pressure greater or less than 40 psia above ambient pressure, but is preferably a pressure in excess of about 20 psia above ambient pressure.

Accordingly, as used herein to describe the disclosed embodiment, "yield point pressure" is defined as that given internal pressure in a tubular member at which the compliance of the tubular member is greater than the compliance of the tubular member below the given internal pressure, and corresponds generally to the base pressure. In the disclosed embodiment, yield point pressure is physically manifested by a relatively rapid increase in diameter of a tubular member or a bulging at one longitudinal region of a tubular member that is controlled by the design of the tubular member. To cause this increase in diameter or bulging to occur at a given longitudinal region of the tubular member, the member may be cast or otherwise manufactured with a reduced wall thickness or enlarged diameter at a predetermined longitudinal location, e.g., a predetermined distance from one end of the tubular member. It may also be possible to cast, extrude or otherwise manufacture tubular members that do not manifest the aforementioned bulging at one longitudinal region, but rather increase radially substantially uniformly along substantially the entire longitudinal extent of the pressurized tubular member beginning at the base pressure.

Above the base or yield point pressure, continued introduction of pressurized air into the tubular members causes the volume of the tubular members to increase until each tubular member is constrained to its maximum inflated volume both radially and longitudinally by its surrounding first sleeve. At its maximum inflated volume, each tubular member has an internal pressure substantially greater than ambient, e.g., from about 40 psia to about 60 psia or more greater than ambient up to the maximum pressure of the first stage regulator, which is typically about 140 psia. Because the internal base pressure of the elastic tubular members is always higher than ambient pressure, the change of lift or volume with water depth for the BCD of the invention is advantageously much less than that of the conventional BCD. In other words, the BCD of the invention will maintain a much more constant displacement and lift over a typical dive profile than the conventional BCD. With an appropriate selection of elastomeric materials and design of the elastic tubular members, the lift versus depth characteristic of the BCD of the invention can be made relatively comparable to that of a constant or fixed volume BCD.

When a plurality of elastic members, e.g., four, is used in the BCD of the invention, flow restrictors may be included in the inlet to each elastic member should the elastic members not inflate uniformly together. Such flow restrictors will avoid any unbalance in the lift forces that would otherwise occur, for example, if one of the four elastic members inflates before the other elastic members begin inflating.

According to the method aspects of the present invention, the elastic tubular members of the BCD invention may be inflated to an internal base pressure that is always greater than the ambient pressure at any dive depth throughout the working range of diving pressures. During inflation, there is a pressure, defined hereinabove as the "yield point pressure," typically at least 20 psia above ambient, above which the compliance of the tubular members is greater than the compliance of the tubular members below the yield point pressure or base pressure. Below and up to about the yield point pressure, the base volume of the tubular members remains relatively constant. The method of the invention differs substantially from the method of providing buoyancy compensation with conventional BCD bladders which are inelastic in that they are inflatable only to internal pressures corresponding essentially to ambient pressure so that the internal pressure is always the same as ambient pressure. Moreover, when the bladder of a conventional BCD is inflated to its maximum volume, any further introduction of air is typically vented so as to retain the inelasticity of the bladder and maintain the pressure in the bladder at ambient pressure, i.e., at a pressure differential of zero between internal and ambient.

With the foregoing and other objects, advantages and features of the invention that may become hereinafter apparent, the nature of the invention may be more clearly understood by reference to the following detailed description of the invention, the appended claims and to the several drawings forming a part hereof.

DETAILED DESCRIPTION OF THE INVENTION

Figure 1:
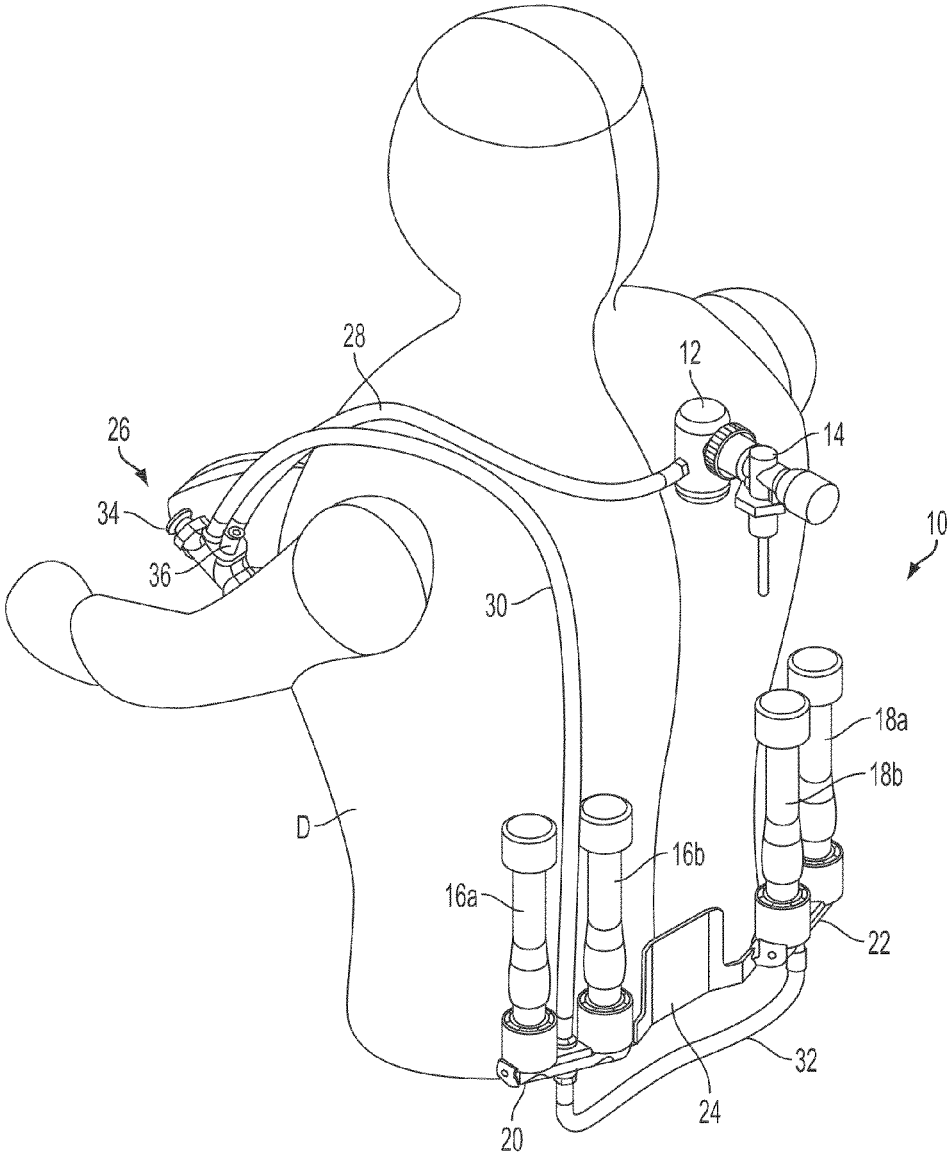
FIG. 1 is a perspective view of one embodiment of the primary components of the BCD of the present invention shown as they would be positioned on the body of a diver without the other components of a conventional SCUBA diving apparatus.

Referring now to FIG. 1 of the drawings, an embodiment of the BCD of the invention is illustrated in perspective on the body of a diver D and is designated generally with reference numeral 10. In the FIG. 1 illustration, the diver's conventional SCUBA equipment is not shown, apart from the first stage regulator 12 and the valve 14 which is connected between the first stage regulator and the pressurized tank of the SCUBA equipment. The BCD 10 of the invention comprises four elastic tubular members 16*a*, 16*b*, 18*a* and 18*b*, which are vertically arranged in two pair 16*a*, 16*b* and 18*a*, 18*b*, respectively, on opposite sides of the diver's lower back. The structure of the elastic tubular members is described in more detail hereinafter in connection with FIGS. 3A, 3B, 4A and 4B. Each pair of tubular members is connected to a respective left and right manifold 20, 22, which, in turn, are affixed to a manifold mounting bracket 24. Bracket 24 is mounted on the diver's SCUBA equipment (not shown), e.g., on the frame or jacket that supports the pressurized tank of the SCUBA equipment.

A single slide valve 26 having three positions, "neutral" or "off," "inflate," and "deflate" or "dump" is connected to the first stage regulator 12 by an inflation hose 28, which passes over the left shoulder of the diver D. Preferably, the slide valve 26 is manually operated and is spring-biased to the neutral or off position so that no air passes through the slide valve. A first inflation/dump hose 30 is connected between the slide valve 26 and the left manifold 20 also passing over the left shoulder of the diver D. A second inflation/dump hose 32 is connected between the left and right manifolds 20, 22.

When the diver D desires to provide lift during a dive, he manually operates the operator lever 34 to move the slide valve 26 from its neutral or off position to the inflate position to admit pressurized air from the pressurized air source (not shown) through the first stage regulator 12, the inflation hose 28, slide valve 26, inflation/dump hoses 30, 32, manifolds 20, 22 and into the bottom of each elastic tubular member 16*a*, 16*b*, 18*a* and 18*b* to begin inflating all the tubular members simultaneously. When the desired magnitude of lift is achieved, the diver D releases the operator lever 34 of the slide valve 26 and the slide valve automatically returns to its neutral or off position. If the diver D wishes to decrease lift, he manually operates the operator lever 34 to the deflate or dump position to release air from the tubular members 16*a*, 16*b*, 18*a* and 18*b* through the manifolds 20, 22, the inflation/dump hoses 30, 32 and exhaust port 36 on the body of the slide valve to ambient. When the desired decrease in lift has been achieved, the diver D releases the operator lever 34 and the slide valve automatically returns to its neutral or off position. If desired, a relief valve (not shown) may also be provided in the body of the slide valve 26 or elsewhere in the inflation circuit of the BCD 10 to prevent overpressure in the tubular members.

Those skilled in the art will appreciate that there are many other possible valve and hose configurations that may be used to inflate and deflate the tubular members so that the present invention is not to be limited by the particular valve and hose configuration shown in FIG. 1.

Figure 2:
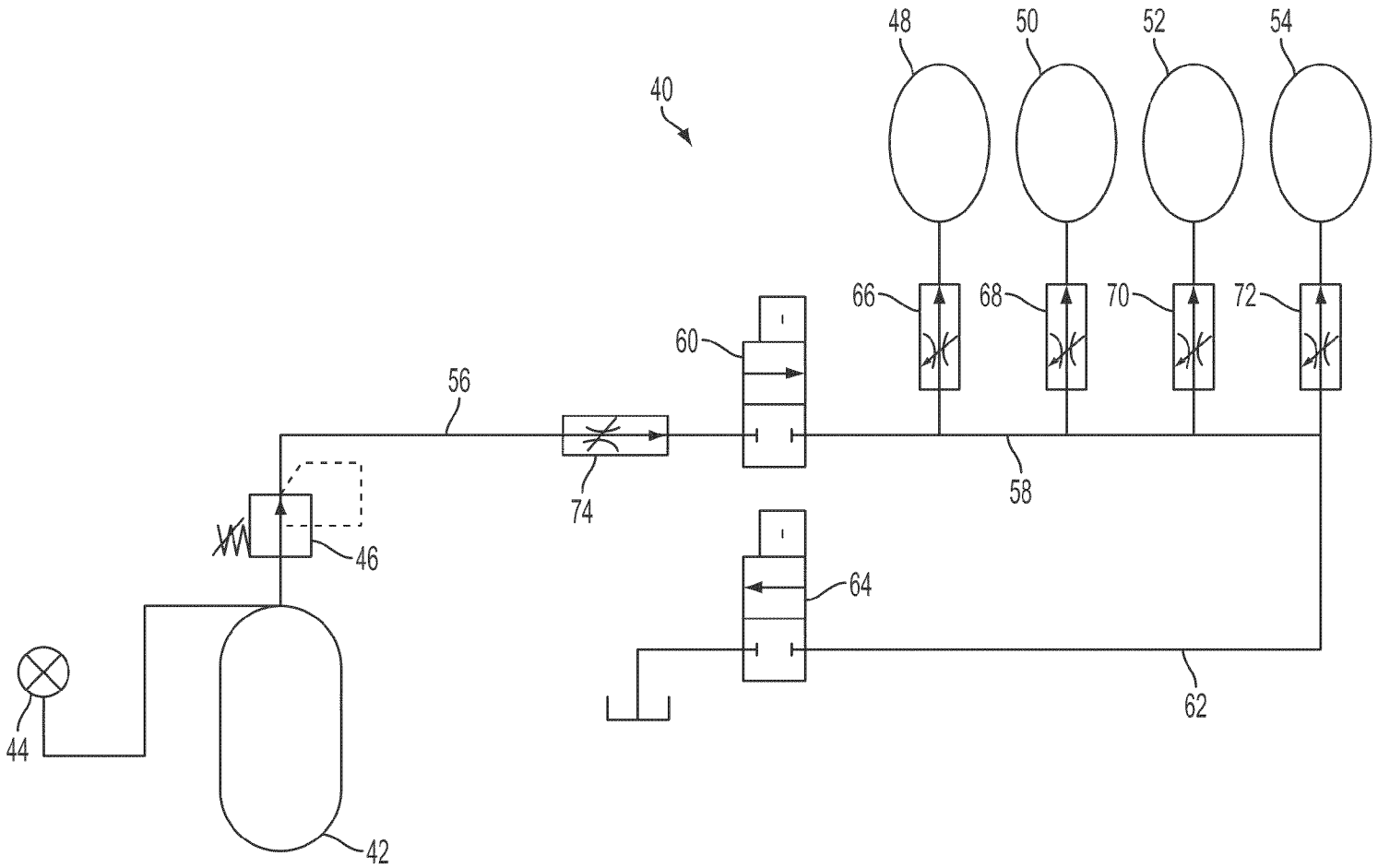
FIG. 2 is a schematic view of the pneumatic system of the embodiment of the BCD invention shown in FIG. 1.

FIG. 2 is a pneumatic schematic of another embodiment of the BCD of the present invention which is designated generally by reference numeral 40. In this embodiment, a conventional SCUBA tank 42 provides a source of pressurized air for the BCD 40 via a valve 44 and first stage regulator 46. BCD 40 comprises four elastic members 48, 50, 52, 54 connected to the first stage regulator 46 by inflation hoses 56, 58. A two-position inflation valve 60 is connected between hoses 56, 58 for admitting pressurized air into the elastic members. Air is exhausted to ambient from the elastic members via hose 62 and two-position dump valve 64. Flow restrictors 66, 68, 70, 72 are provided in the inlet to each elastic member so that the elastic members inflate evenly together. Such flow restrictors will help avoid any unbalance in the lift forces that would otherwise occur if, e.g., one of the four elastic members fully inflates before any other elastic member begins inflating. A flow restrictor 74 may also be provided between hose 56 and valve 60 to limit the flow rate of the air entering the elastic members.

Figure 3A:
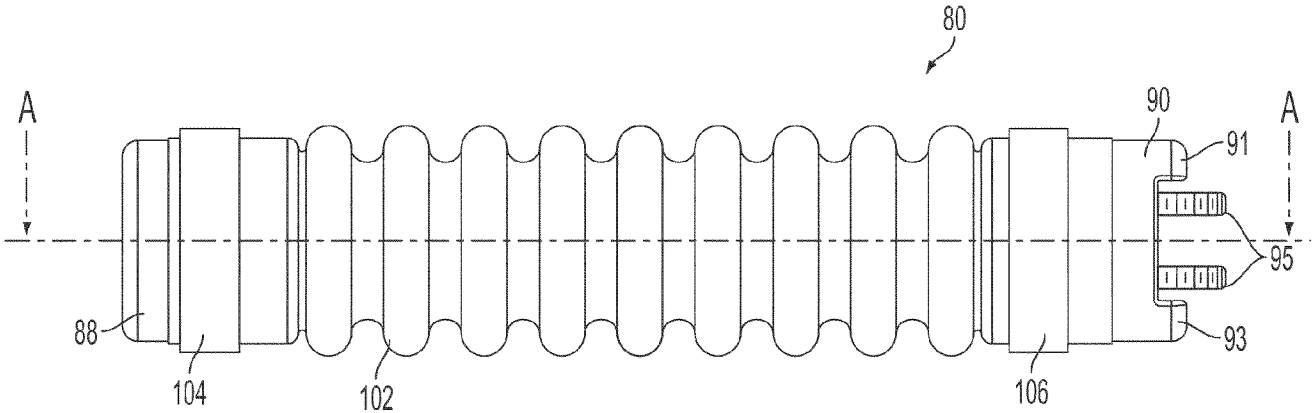
FIGS. 3A and 3B are plan and cross-sectional views of an uninflated elastic tubular member of the embodiment of the BCD invention shown in FIG. 1, with the cross-sectional view of FIG. 3B taken along plane A-A of FIG. 3A.
Figure 3B:
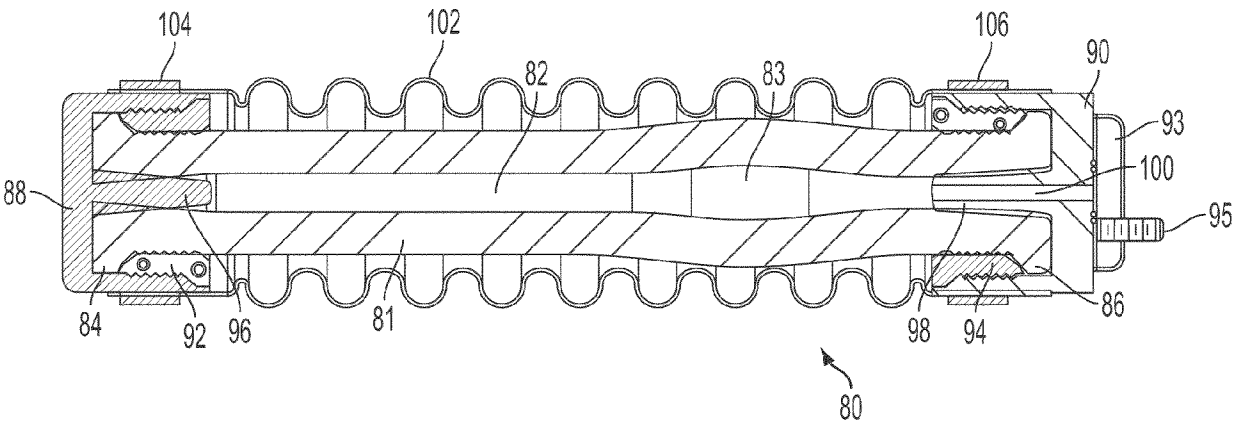

Referring now to FIGS. 3A and 3B, a representative elastic member assembly 80 of the invention is shown in plan and cross-sectional views, respectively, in its unexpanded or uninflated, but still elastic condition. Elastic member assembly 80 comprises a substantially cylindrical tubular member 81 (FIG. 3B) cast or otherwise formed of an elastomeric material, preferably a silicone rubber, such as a high shear and tear resistant Shore A (25-40) silicone rubber manufactured by Dow Chemical Company or Axon AB Plastics. Tubular member 81 is formed with a central through passage 82 and at its ends with outwardly extending flanges 84, 86. Central through passage 82 is formed with a slightly enlarged portion 83 for a purpose to be described and has a relatively small volume at atmospheric pressure, e.g., about 0.1 liter.

Flanges 84, 86 are captured and secured in a respective top and bottom end cap 88, 90 by means of a respective pair of split retainer sleeves 92, 94. As shown in FIG. 3B, split retainer sleeves 92, 94 are threaded on their outer circumferential surfaces so as to threadably engage the threads on the inner circumferential surfaces of the top and bottom end caps 88, 90. Split retainer sleeves 92, 94 are also threaded on their inner circumferential surfaces so that when the split sleeves 92, 94 are threaded into the end caps 88, 90 to capture and seal the flanges 84, 86 against a respective end cap, they also grip the outer circumferential wall surfaces of the tubular member 81 adjacent the flanges 84, 86 to securely hold the tubular member 81 in the end caps 88, 90.

Top end cap 88 is provided with a central elongated pin 96 that extends into and supports the central passage 82, 83 of the tubular member 81. Bottom end cap 90 is also provided with a central pin 98 that sealingly extends into the central passage 82 of tubular member 81. Pin 98 is provided with a central bore 100 through which pressurized air is admitted and exhausted as explained in more detail hereinafter. Bottom end cap 90 also differs from top end cap 88 in that it is provided with a pair of lugs 91, 93 and screws 95 for securing the elastic member assembly 80 to one of the manifolds 20, 22 (FIG. 1).

Elastic member assembly 80 also includes a first tubular sleeve 102, preferably made of a substantially non-stretchable woven nylon fabric, which surrounds the tubular member 81 and is affixed at its sleeve ends to a respective end cap 88, 90 by means of clamps 104, 106 or any other suitable fastening means. Sleeve 102 is illustrated in a bellows-like form in FIGS. 3A and 3B only to indicate that, in the uninflated or unexpanded condition of the elastic member assembly 80, the sleeve is in a slack condition. Accordingly, sleeve 102 may have other regular or irregular shapes gathered about the tubular member 81. First sleeve 102 serves to limit the maximum expansion of the tubular member 81 in the radial as well as in the axial or longitudinal direction so as to prevent over expansion of the tubular member beyond its desired maximum size and internal volume.

Figure 4A:
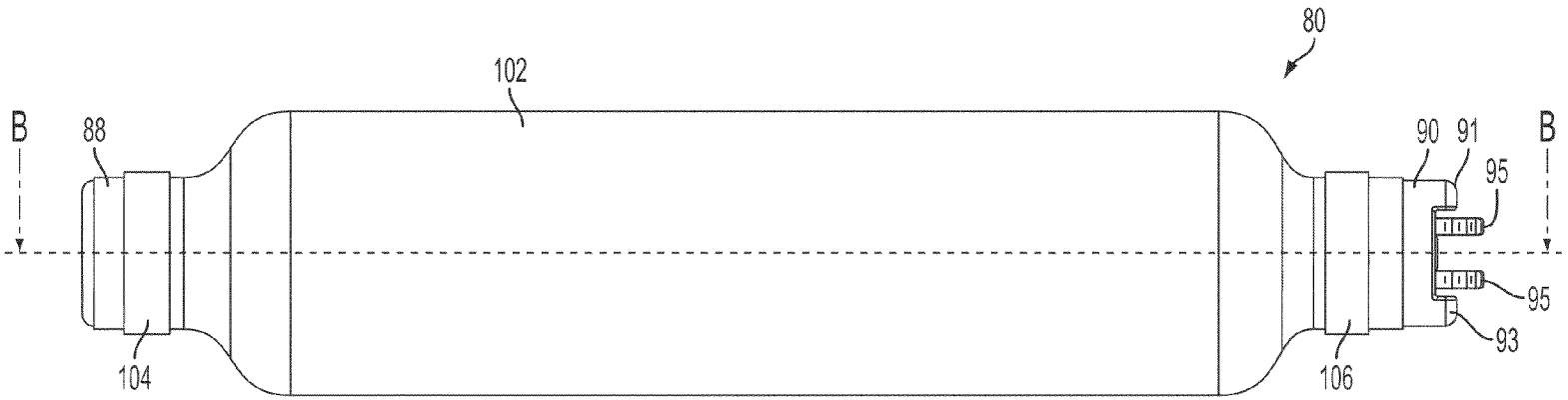
FIGS. 4A and 4B are plan and cross-sectional views of an inflated elastic tubular member of the embodiment of the BCD invention shown in FIG. 1, with the cross-sectional view of FIG. 4B taken along plane B-B of FIG. 4A.
Figure 4B:
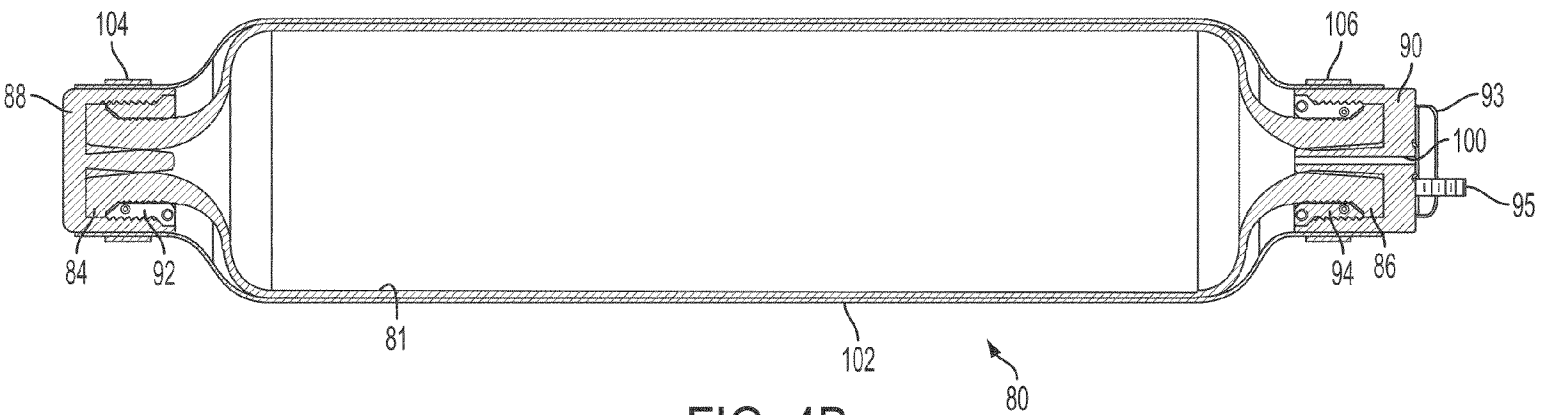

Referring now to FIGS. 4A and 4B, elastic member assembly 80 of the invention and of FIGS. 3A and 3B is shown in plan and cross-sectional views, respectively, in its expanded or inflated condition. In this condition, pressurized air has been admitted through central bore 100 into central passage 82, 83 and has inflated or expanded the elastic tubular member 81 to its maximum internal volume, e.g., about 2.25 liters. First sleeve 102 is taut in both the axial and longitudinal directions and, thus, substantially prevents further expansion of the tubular member 81 and further increase in its internal volume.

As described above, during introduction of pressurized air into the bore 100, the central passage 82, 83 of tubular member 81 remains at a substantially constant volume, e.g., about 0.1 liter, until the base pressure or yield point pressure is reached. Then, at base pressure or yield point pressure, e.g., 20-40 psia, the tubular member 81 begins to expand or increase its internal volume beginning at the enlarged diameter portion 83 of the central passage 82. Instead of providing an enlarged diameter portion 83 in the central passage 82 to initiate expansion at a specific location along the length of the tubular member 81, a constant internal diameter of the tubular member with a reduced wall thickness at a specific location will also initiate expansion at that location.

Figure 5:
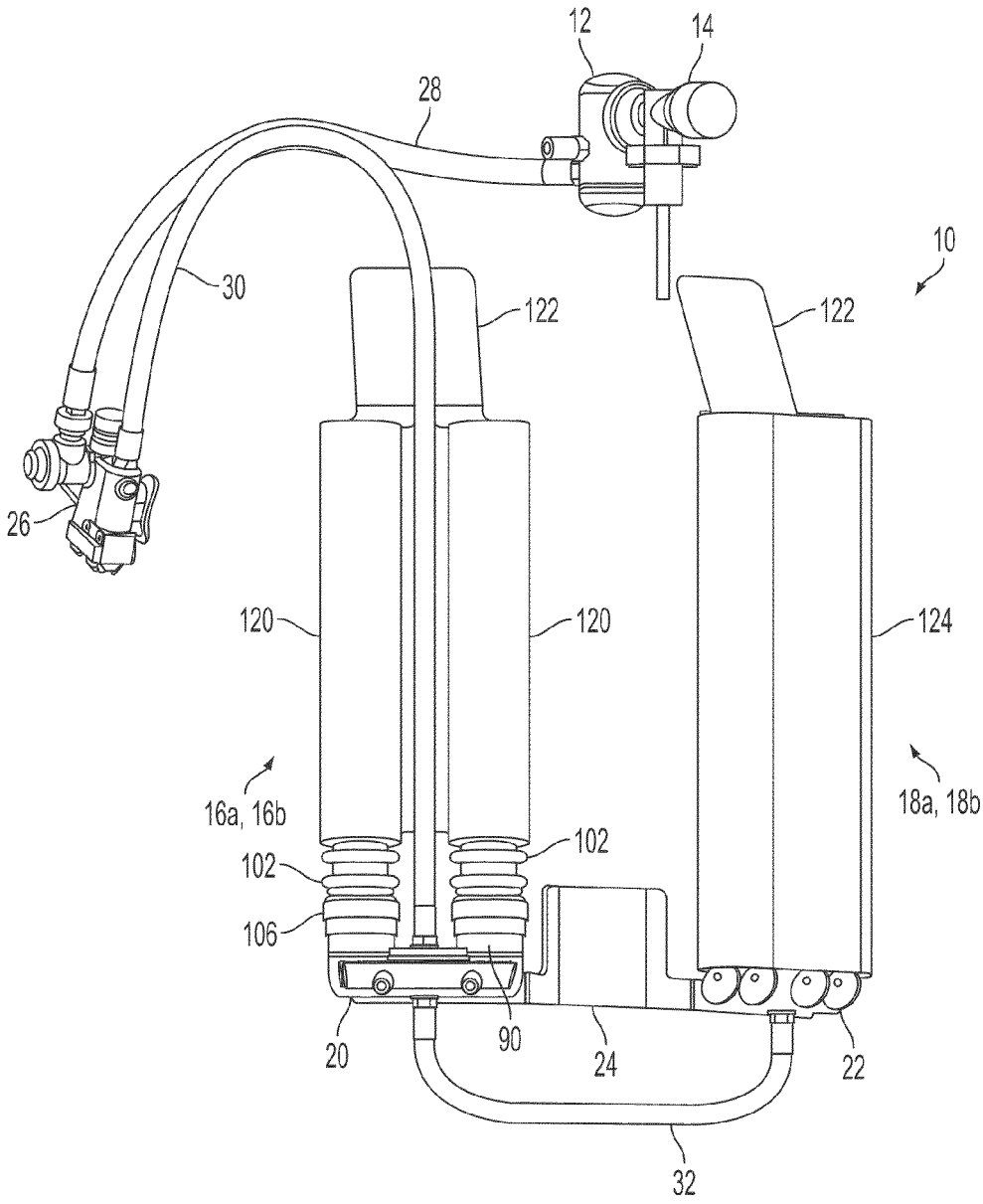
FIG. 5 is a perspective view of the embodiment of the BCD invention depicted in FIG. 1 in the uninflated condition shown with the first, second and third sleeves.
Figure 6:
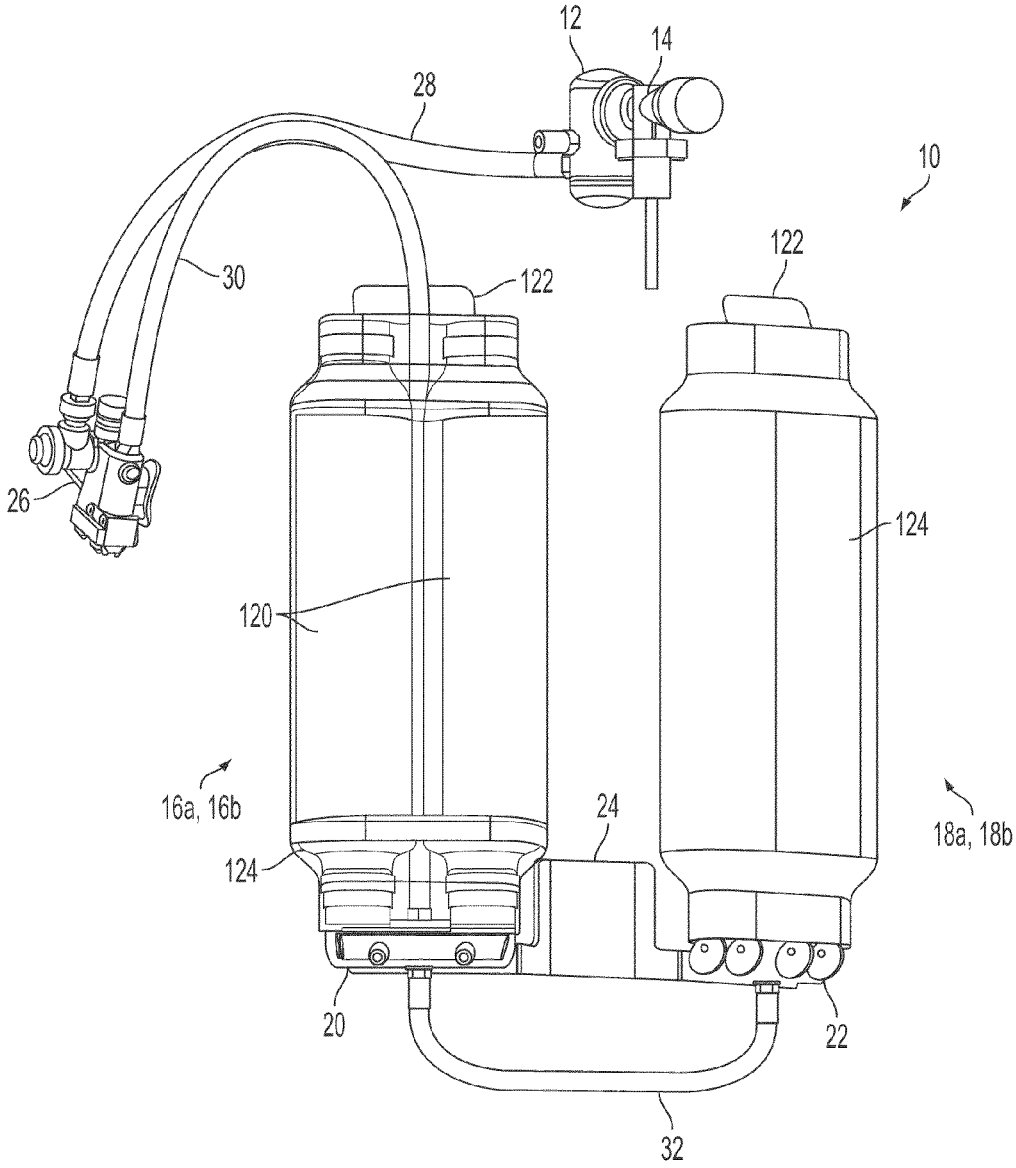
FIG. 6 is a perspective view of the embodiment of the BCD invention depicted in FIG. 1 in the inflated condition shown with the first, second and third sleeves.

FIGS. 5 and 6 illustrate, in perspective and partially cut away, the BCD of the invention 10 in the uninflated and inflated conditions, respectively, that would be connected to a conventional SCUBA apparatus. A conventional SCUBA tank (not shown) provides a source of pressurized air for the BCD 10 via valve 14 and first stage regulator 12. The four elastic tubular members are arranged in pairs 16*a*, 16*b* and 18*a* and 18*b* and are connected to a respective left and right manifold 20, 22 affixed to manifold mounting bracket 24. Bracket 24 is mounted on the diver's SCUBA equipment (not shown), e.g., on the frame or jacket that supports the pressurized tank of the SCUBA equipment. Three position slide valve 26 is connected to the first stage regulator 12 by an inflation hose 28. Inflation/dump hoses 30, 32 are connected between the slide valve 26 and the manifolds 20, 22.

As seen in the uninflated condition of FIG. 5 and the inflated condition of FIG. 6, the tubular members 16*a*, 16*b* and their first sleeves 102 are each loosely enclosed in a second sleeve 120, also made of a substantially non-stretchable nylon fabric. Each second sleeve 120 is affixed at its bottom end to manifold 20 and at its top end to the frame or jacket of the SCUBA diving apparatus (not shown) by a flap 122 using, e.g., a hook-and-loop fastener. The second sleeves 120 keep the tubular members close to the diver's body as previously described.

A third sleeve 124 or covering made of a stretchable material or an elastic fabric, such as spandex, is stretched over each second sleeve 120 to snug each pair of tubular members 16*a*, 16*b* and 18*a*, 18*b* with their first and second sleeves 102, 120 to the diver's back for streamlining and abrasion protection purposes. All the sleeves 102, 120, 124 are porous to air so as not to trap air in any of them.

Figure 7:
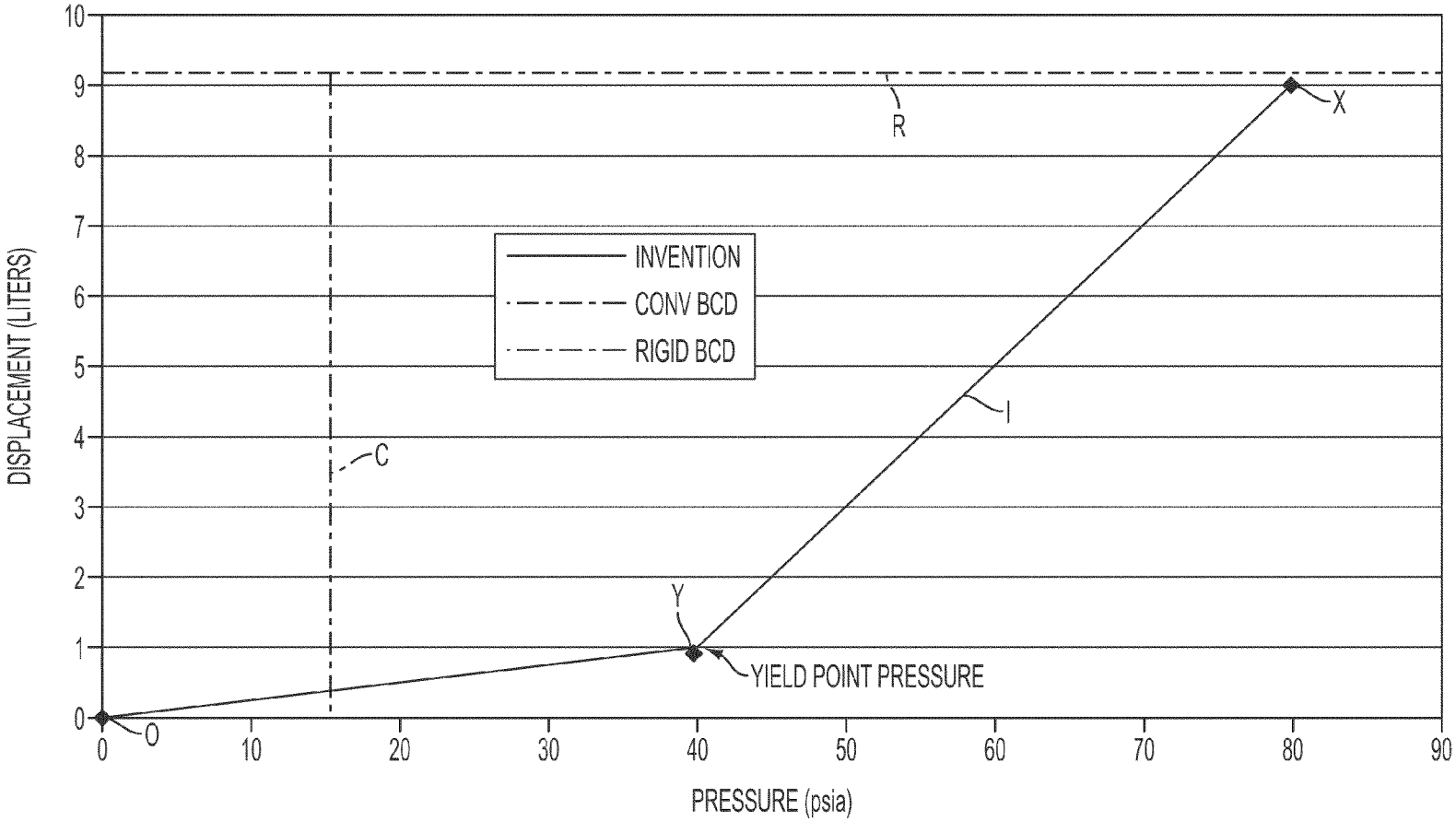
FIG. 7 is a graph comparing displacement versus inflation pressure at ambient atmospheric pressure of the BCD of the invention, a conventional BCD and a fixed volume BCD and showing the yield point pressure of the BCD of the invention.

FIG. 7 is a graphic representation showing the internal displacement versus inflation pressure of a conventional BCD, a rigid BCD and the BCD of the invention when pressurized air is admitted internally to the respective BCD under ambient atmospheric conditions. It should be understood that, except for the rigid BCD, the graphs of FIG. 7 do not illustrate what occurs when the BCDs are inflated at depth, but only at the surface at atmospheric pressure. To illustrate what occurs when the BCDs are inflated at depth, the x-axis of the FIG. 7 graph need only be modified to indicate the "delta pressure," that is, the difference between the internal pressure and the ambient pressure.

The graph R shows that the rigid tank BCD maintains a constant volume or internal displacement of about 9 liters regardless of the inflation pressure. This, of course, assumes that the walls of the rigid tank BCD are perfectly rigid, that is, the walls do not flex inwardly or outwardly as air is evacuated or introduced into the tank and the tank is not flooded with any water to decrease its total displacement of about 9 liters.

The graph C of the conventional BCD shows that this BCD, when inflated at atmospheric pressure, increases its internal displacement from zero to about 9 liters with no change in internal pressure, i.e., atmospheric pressure. This assumes that the substantially inelastic, inflatable bladder previously described as the "conventional BCD" is not inflated to the point where the material of the bladder is under tension or is stretched, a condition that is never operational for the conventional BCD.

Graph I illustrates the displacement versus inflation pressure of the embodiment of the invention described herein, that is, a BCD using four tubular members constructed according to the embodiment shown in FIGS. 1-6. The tubular members of the invention have an internal volume of zero when the internal pressure is 0.0 psia (a vacuum) as shown in FIG. 7 at the origin or point O. At atmospheric pressure or 14.7 psia, the combined volume or internal displacement of the four tubular members is about 0.4 liters, or about 0.1 liter for each tubular member as described above in connection with FIGS. 3A and 3B.

Assuming pressurized air is initially introduced into the tubular members of the invention when their internal pressure is at atmospheric pressure (14.7 psia) as in the conventional BCD, it can be seen that the internal pressure of the four tubular members increases up to the yield point pressure of about 40 psia at point Y while their total internal volume remains relatively constant with an increase of only about 0.5-0.6 liter. Thus, in the region from atmospheric pressure to point Y at 40 psia, the compliance of the elastic tubular members, defined above as the change in volume as a function of pressure (dV/dP), is low or substantially zero. At pressures above yield point pressure at point Y, the tubular members are more compliant, but still require a substantial increase in inflation pressure (up to 80 psia) to increase the total internal volume of the four tubular members to 9 liters at point X. In contrast, the compliance of the conventional, inelastic BCD is essentially infinite. This compliance characteristic of the elastic members of the invention is one of the features that distinguishes the BCD of the invention from the prior art BCDs.

Figure 8:
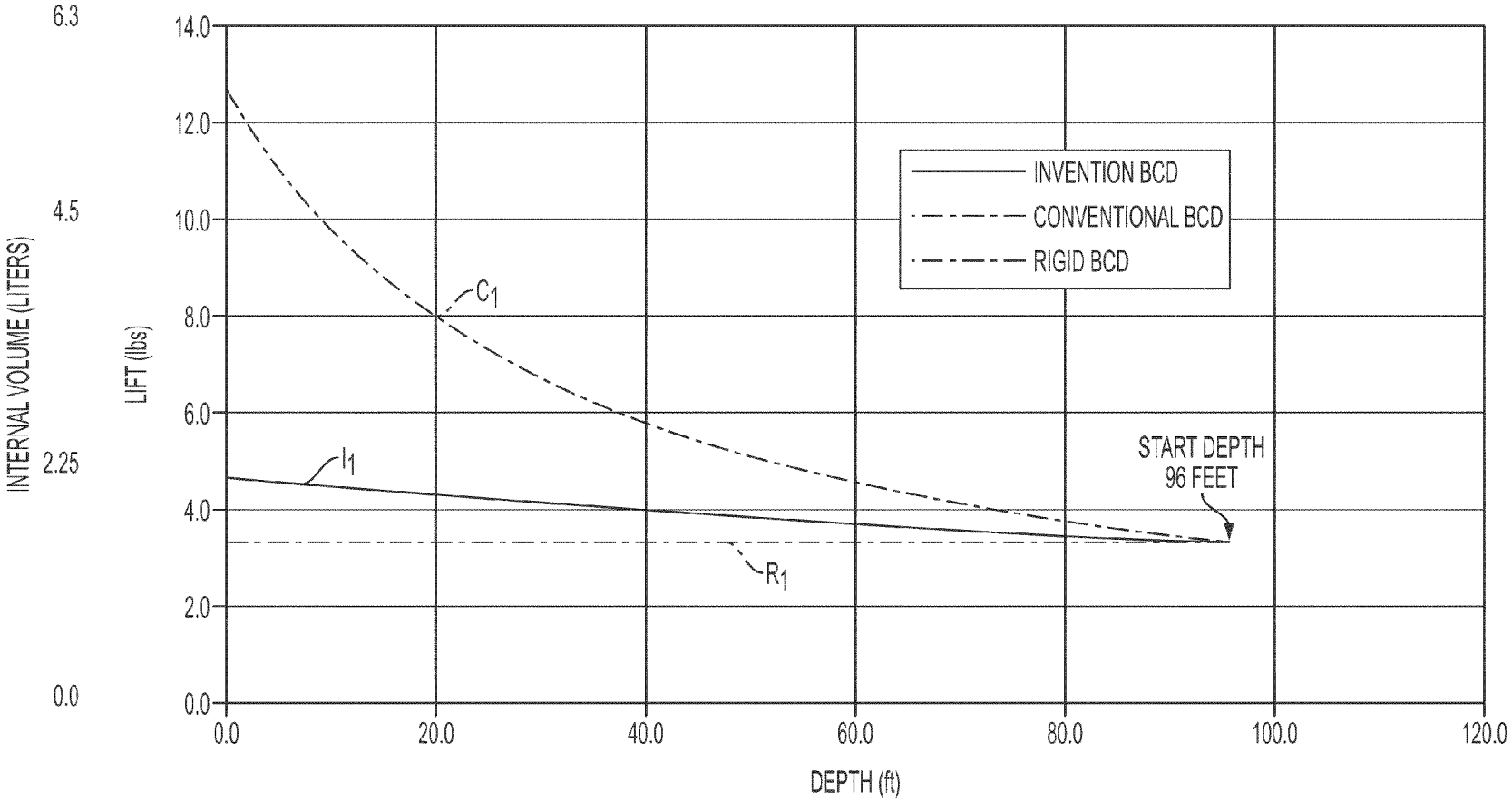
FIG. 8 is a graph comparing lift and internal volume versus depth of the BCD of the invention, a conventional BCD and a fixed volume BCD with a start depth of 96 feet and an initial lift of about 3.0 lbs.

FIG. 8 illustrates more particularly how the BCD of the invention differs from the conventional BCD in an operating (diving) environment in sea water. FIG. 8 shows the lift characteristics of each of the three types of BCD (rigid, conventional and the invention) during ascent, assuming a diver's lowest or bottom depth of 96 feet and ending at the water surface or zero depth and assuming no flooding of the rigid BCD and no venting of the air in the BCDs during ascent. Each of the three BCDs has a beginning internal volume of about 1.5-1.75 liters and a lift force of about 3.2 pounds at 96 feet depth (about 57 psia in sea water). Referring first to curve $R_1$ for the rigid tank BCD, as expected, the internal volume and lift force of the rigid tank BCD remains constant as the diver ascends from the 96 foot depth to the surface. Looking now at the curve $C_1$ for the conventional BCD, it is seen that, as the diver ascends from 96 feet depth (4 atm. pressure) toward the surface (1 atm. pressure), the internal volume and thereby the lift force of the conventional BCD increase by a factor of four to almost 6 liters volume and about 13 pounds of lift force. It is this lift characteristic of the conventional BCD that has the potential to create a dangerous condition during ascent for the diver, experienced or not, as explained hereinbefore.

Referring now to curve $I_1$ for the BCD of the invention, as the diver ascends from 96 feet to the surface, the internal volume and lift increase only slightly, i.e., about 0.5 liter increase in volume and about 1.2 pounds lift force. Such a small increase in volume and lift force makes it easy for the diver to maintain complete and safe control of his ascent using the BCD of the invention. It can also be seen that the BCD of the invention has a lift characteristic substantially the same as that of the rigid tank BCD, i.e., constant, when a diver ascends to the surface from depth.

Figure 9:
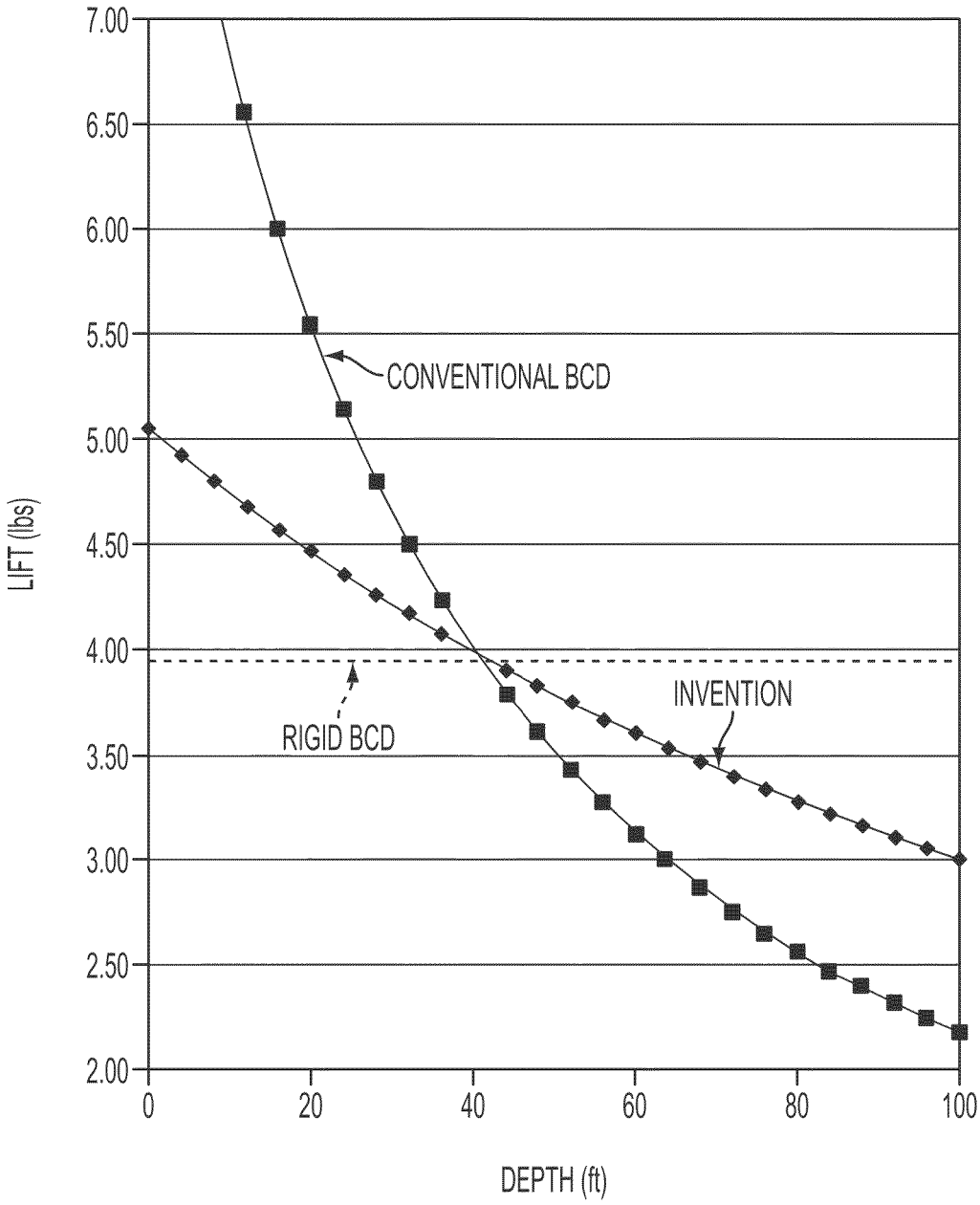
FIG. 9 is a graph comparing internal volume versus depth of the BCD of the invention, a conventional BCD and a fixed volume BCD both up and down from a start depth of 40 feet at an initial lift of 4.0 lbs.
Figure 10:
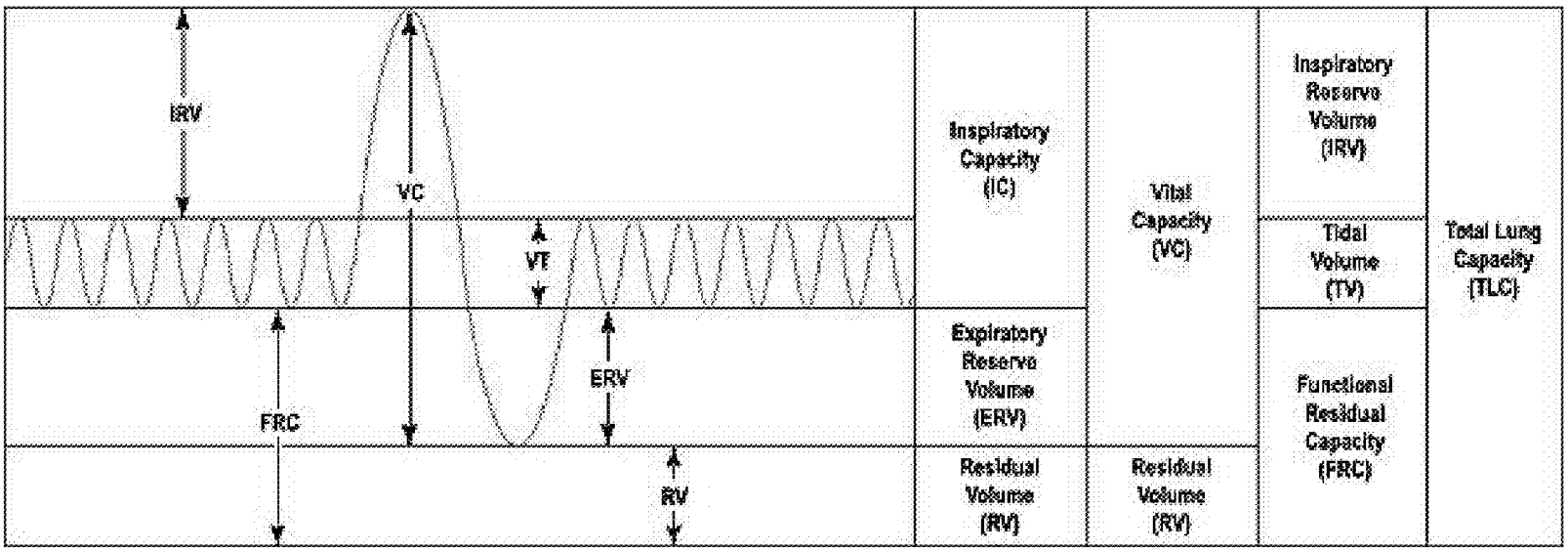
Fig. 10 Prior Art
FIG. 10 is a chart showing a typical representation of lung volumes measured at atmospheric pressure.

FIG. 9 illustrates the lift versus depth curves for the three BCDs (rigid, conventional and the invention) for a typical dive profile between 100 feet depth and the surface. Assuming all three BCDs are adjusted for a typical lift of 4.0 pounds at a depth of 40 feet, the lift of the rigid tank BCD remains constant at 4.0 pounds. However, it can be seen from FIG. 9 that the lift for the BCD of the invention varies by only 2.0 pounds from 100 feet depth (3.0 pounds lift) to the surface (5.0 pounds lift), whereas the lift of the conventional BCD varies by approximately 7.0 pounds from 100 feet depth (2.25 pounds lift) to the surface (about 9.3 pounds lift).

From the foregoing detailed description and drawings, it will be appreciated by those skilled in the art that the BCD of the invention meets the objectives described above for providing a safer, less complex and cumbersome BCD for divers.

Although certain presently preferred embodiments of the invention have been specifically described herein, it will also be apparent to those skilled in the art to which the invention pertains that variations and modifications of the various embodiments shown and described herein may be made without departing from the spirit and scope of the invention. Accordingly, it is intended that the invention be limited only to the extent required by the appended claims and the applicable rules of law.

What is claimed is:

1. A buoyancy compensation system for an underwater diver comprising a source of pressurized gas, at least one member having an initial internal volume and a final internal volume, an inlet connected between said source and the internal volume of the member, means for controllably introducing pressurized gas into the internal volume of said member to expand said member to any one of a plurality of given internal volumes between said initial and final internal volumes, said one given internal volume being greater than the initial internal volume, said member being elastic at each one of said given internal volumes above said initial internal volume, the internal pressure in said member at each one of said plurality of given internal volumes of said expanded member being always greater than ambient pressure at any dive depth.

2. The buoyancy compensation system of claim 1, including a sleeve surrounding said member for limiting the maximum internal volume of said member.

3. The buoyancy compensation system of claim 1, wherein said member has a yield point pressure and a compliance equal to the change in internal volume as a function of the change in internal pressure ($\Delta V/\Delta P$) of said member during introduction of pressurized gas, the compliance of said member at pressures above the yield point pressure being greater than the compliance of said member at pressures below the yield point pressure.

4. The buoyancy compensation system of claim 3, wherein the compliance of said member at pressures below the yield point pressure is substantially constant.

5. The buoyancy compensation system of claim 3, wherein the internal volume of said member up to the yield point pressure is about less than 0.1 liter.

6. The buoyancy compensation system of claim 3, wherein the internal volume of said member up to the yield point pressure remains substantially constant and at pressures above the yield point pressure the internal volume of said member increases as a function of pressure up to the given volume.

7. The buoyancy compensation system of claim 3, wherein said member comprises an elastic tubular member.

8. The buoyancy compensation system of claim 7, wherein said elastic tubular member is made of silicone rubber.

9. The buoyancy compensation system of claim 7, wherein said elastic tubular member has a variable wall thickness and/or diameter for controlling the magnitude of the yield point pressure.

10. The buoyancy compensation system of claim 7, wherein said elastic tubular member has a variable wall thickness and/or diameter for controlling the location at which the elastic tubular member begins to initially expand.

11. The buoyancy compensation system of claim 7, including a plurality of said elastic tubular members.

12. The buoyancy compensation system of claim 11, including top and bottom end caps mounted to opposite ends of each elastic tubular member for sealing the ends of each elastic tubular member, a substantially non-stretchable first sleeve surrounding each elastic tubular member and affixed at its ends to the top end bottom end caps for limiting the volumetric expansion of each elastic tubular member.

13. The buoyancy compensation system of claim 12, including a substantially non-stretchable second sleeve surrounding said elastic tubular members and the first sleeves for retaining said elastic tubular members against the body of the diver.

14. The buoyancy compensation system of claim 3, wherein the yield point pressure is greater than 20 psia above ambient pressure.

15. The buoyancy compensation system of claim 3, wherein the yield point pressure is greater than 40 psia above ambient pressure.

16. The buoyancy compensation system of claim 1, including an inflation valve connected between the source and the inlet for admitting pressurized gas into said member and a dump valve connected between the inlet and ambient for dumping air from said member to ambient.

17. The buoyancy compensation system of claim 16, wherein the inflation and dump valves are manually operated.

18. The buoyancy compensation system of claim 16, wherein the inflation and dump valves are combined in a manually operated slide valve.

19. The buoyancy compensation system of claim 16, including a relief valve connected between said inlet and ambient for preventing over pressure in said member.

20. A buoyancy compensation system for an underwater diver comprising a source of pressurized gas, at least one elastic member having initial and final internal volumes and a yield point pressure greater than the ambient pressure at any dive depth, an inlet connected between the internal volume of said elastic member and said source for controllably introducing pressurized gas into said elastic member to expand said elastic member to any one of a plurality of given internal volumes between the initial and final internal volumes, the initial internal volume remaining substantially constant up to the yield point pressure, then increasing at internal pressures above the yield point pressure, the internal pressure in the internal volume of the expanded elastic member being always greater than ambient pressure at any dive depth.

21. The buoyancy compensation system of claim 20, including a sleeve surrounding said elastic member for limiting the maximum internal volume of said elastic member.

22. The buoyancy compensation system of claim 20, wherein said elastic member has a compliance equal to the change in internal volume as a function of the change in internal pressure ($\Delta V/\Delta P$) of said elastic member during introduction of pressurized gas, the compliance of said elastic member at pressures above the yield point pressure being greater than the compliance of said elastic member at pressures below the yield point pressure.

23. The buoyancy compensation system of claim 22, wherein the compliance of said elastic member at pressures below the yield point pressure is substantially constant.

24. The buoyancy compensation system of claim 20, including a manually-controlled first valve connected to said inlet for admitting pressurized gas into said internal volume and a manually-controlled second valve connected to said inlet for dumping pressurized gas from said internal volume to ambient.

25. The buoyancy compensation system of claim 24, wherein the manually-controlled first and second valves comprise a slider valve.

26. The buoyancy compensation system of claim 20, including a substantially non-stretchable first sleeve surrounding said elastic member for limiting the volumetric expansion of said elastic member and a substantially non-stretchable second sleeve surrounding said elastic member and said first sleeve for retaining said elastic member and first sleeve against the body of the diver.

27. The buoyancy compensation system of claim 20, wherein the expanded elastic member provides substantially constant lift at dive depths in the range from zero to 150 feet.

28. A method of providing buoyancy compensation to an underwater diver comprising:

providing a buoyancy compensation device comprising a source of pressurized gas and at least one member having an initial internal volume and a final internal volume, an inlet connected between the internal volume of said member and said source, said member being elastic at all internal volumes;

introducing pressurized gas into the internal volume of said member to expand said member to any one of a plurality of given volumes between the initial and final internal volumes such that the internal pressure in the given volume of said expanded elastic member is always greater than ambient pressure at any dive depth; and controlling the introduction pressurized gas into the internal volume of said member to limit the internal volume to any one of said given volumes between the initial and final volumes.

29. The method of claim 28, wherein said member has a yield point pressure and a compliance equal to the change in internal volume as a function of the change in internal pressure ($\Delta V/\Delta P$) of said member during introduction of pressurized gas, the compliance of said member at pressures above the yield point pressure being greater than the compliance of said member at pressures below the yield point pressure.

30. The method of claim 28, wherein the compliance of said member at pressures below the yield point pressure is substantially constant.

31. The method of claim 28, wherein the initial internal volume of said member remains substantially constant up to the yield point pressure.

32. The method of claim 28, wherein the yield point pressure is always greater than ambient pressure at any dive depth.

33. The method of claim 28, wherein the expanded elastic member provides substantially constant lift at dive depths in the range from zero to 150 feet.

34. The method of claim 28, wherein the increase in lift of the expanded elastic member during ascent is equal to or less than the decrease in lift of a forced expiration of the diver.

* * * * *